United States Patent [19]

Gummow

[11] Patent Number: 4,924,737

[45] Date of Patent: May 15, 1990

[54] POSITIVE DRIVE RATCHET

[75] Inventor: Stephen A. Gummow, Rockford, Ill.

[73] Assignee: Gummow Tool Company, Rockford, Ill.

[21] Appl. No.: 325,767

[22] Filed: Mar. 20, 1989

[51] Int. Cl.[5] ..... B25B 13/46

[52] U.S. Cl. ..... 81/63.2; 192/45.1

[58] Field of Search ..... 81/58.4, 60–63.2; 192/43, 43.1, 45.1

[56] References Cited

U.S. PATENT DOCUMENTS

| | | | |
|---|---|---|---|
| 2,542,323 | 2/1951 | Gearhart | 192/45.1 |
| 2,657,604 | 11/1953 | Rueb | 81/63.2 |
| 4,669,339 | 6/1987 | Cartwright | 81/59.1 |

FOREIGN PATENT DOCUMENTS

| | | |
|---|---|---|
| 2227616 | 12/1973 | Fed. Rep. of Germany . |
| 2245044 | 3/1974 | Fed. Rep. of Germany . |
| 2246175 | 3/1974 | Fed. Rep. of Germany . |

*Primary Examiner*—James G. Smith

*Attorney, Agent, or Firm*—Leydig, Voit & Mayer

[57] ABSTRACT

A reversible ratchet for driving a socket wrench includes a ring gear which constantly meshes with an inner gear adapted to turn about an axis that is eccentric with respect to the axis of the ring gear. When the ratchet is turned in a driving direction, a crescent-shaped member wedges between the two gears and causes the ring gear to transmit torque to the inner gear in order to drive the socket. When the ratchet is turned in the opposite direction, the crescent moves out of wedging engagement with the gears and permits the inner gear to turn about its own axis as the teeth of the ring gear roll into and out of the teeth of the inner gear. Because the gears contantly mesh with one another, the drive picks up immediately when the ratchet is turned in the driving direction and thus the ratchet may be used effectively in very close quarters.

13 Claims, 2 Drawing Sheets

Fig. 5.
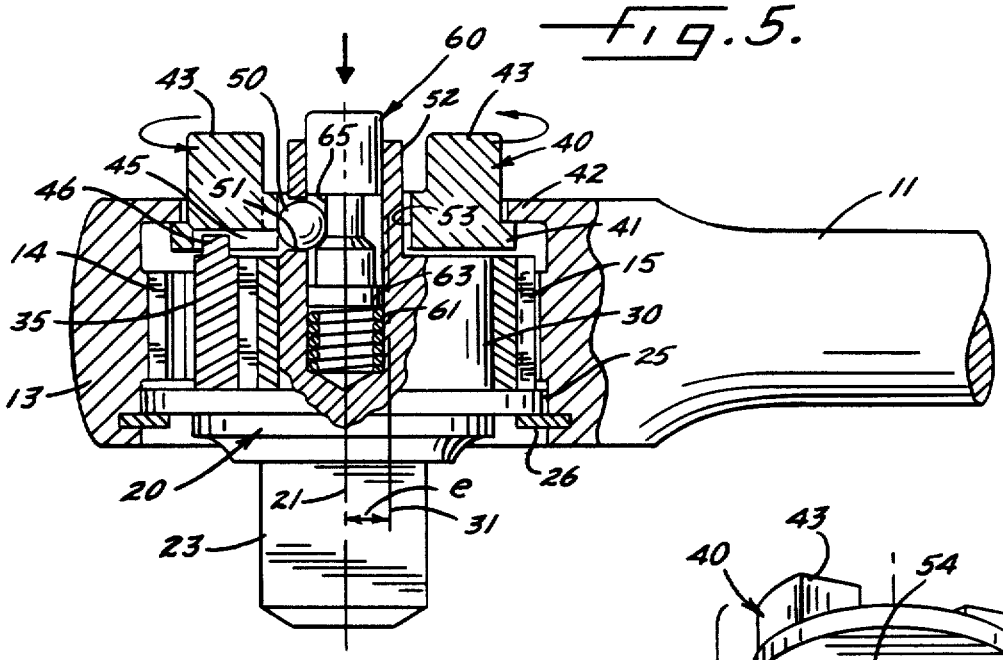
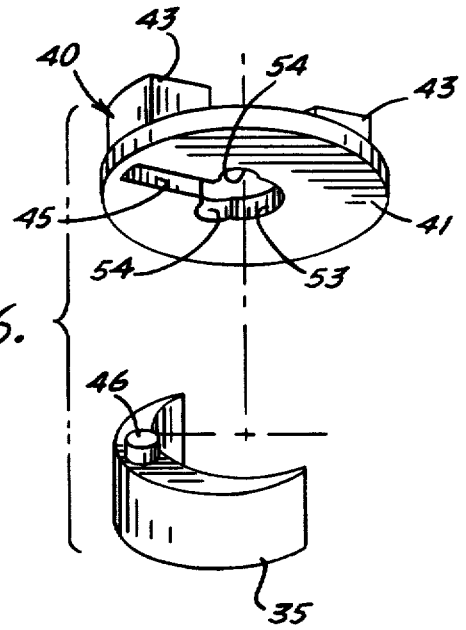
Fig. 6.

POSITIVE DRIVE RATCHET

BACKGROUND OF THE INVENTION

This invention relates generally to a ratchet and, more particularly, to a reversible ratchet for driving a tool such as a socket wrench. As is conventional, the ratchet can be set to drive when turned in a first direction and to free-wheel when turned in the opposite direction. Also, the ratchet can be selectively reversed so as to free-wheel when turned in the first direction and to drive when turned in the opposite direction.

Most commercially available ratchets operate by virtue of the coaction of two toothed members, one of the toothed members usually being in the form of a ring gear in the handle of the ratchet. The toothed members engage one another during driving of the ratchet and then slip past one another as the ratchet free-wheels.

One difficulty with ratchets of this type is that it is often necessary to swing the handle through a substantial angle before the toothed members drivingly re-engage after free-wheeling. As a result, it may not be practical to use the ratchet in tight quarters. While the degree of swing can be reduced by the provision of finer teeth on the toothed members, such teeth tend to shear rather easily and thus the torque capacity of the ratchet is reduced.

Other prior ratchets operate by virtue of one smooth member frictionally engaging another smooth member. Although ratchets of this type drive immediately upon being turned, the drive is not positive as is the case with coacting toothed members. Moreover, the number of components and the critical tolerances of such a ratchet make the ratchet very expensive to manufacture.

SUMMARY OF THE INVENTION

The general aim of the present invention is to provide a relatively low cost ratchet which, while having a positive drive through coacting toothed members, immediately picks up and begins driving as soon as the ratchet handle is turned in the driving direction and without need of swinging the handle backward to engage the drive.

A more detailed object of the invention is to achieve the foregoing through the provision of a ratchet in which coacting toothed members remain in engagement with one another at all times during free-wheeling of the ratchet so that the toothed members are in position to drive immediately when the ratchet is turned in the driving direction.

Still another object is to provide a ratchet having relatively low drag during free-wheeling in order to prevent the ratchet from turning a relatively loose fastener as the ratchet is swung in the reverse direction.

The invention also resides in the relatively simple and low cost construction of the components of the ratchet so as to enable the foregoing goals to be attained in a comparatively inexpensive reversible ratchet.

These and other objects and advantages of the invention will become more apparent from the following detailed description when taken in conjunction with the accompanying drawings.

BRIEF DESCRIPTION OF THE DRAWINGS

FIG. 5 is a view similar to FIG. 4 but shows the ratchet in the process of being reversed to change the direction of drive.

FIG. 6 is an exploded perspective view of two of the components of the ratchet.

DETAILED DESCRIPTION OF THE PREFERRED EMBODIMENT

Figure 1:
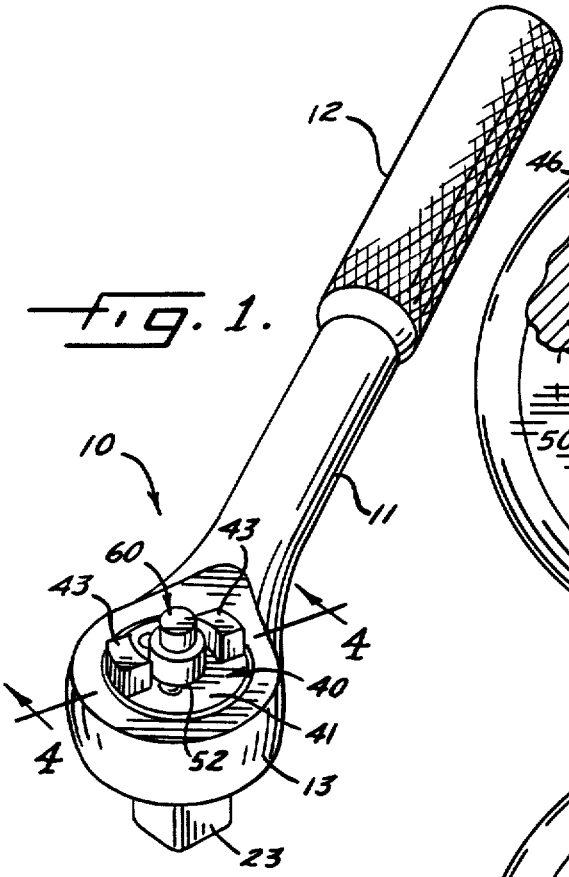
FIG. 1 is a perspective view of a new and improved ratchet incorporating the unique features of the present invention.

As shown in the drawings for purposes of illustration, the invention is embodied in a ratchet 10 of the type adapted to be used with a socket wrench (not shown) or other tool to drive a threaded fastener or similar item. The present ratchet is reversible in that it can be selectively set to drive in either a clockwise or counterclockwise direction and will free-wheel when turned in a direction opposite to the driving direction.

The ratchet 10 includes an elongated handle 11 cast of steel and having a knurled hand grip 12 formed at one end. Formed integrally with the opposite end of the handle is a circular ring 13. As is conventional with many ratchets, the ring 13 of the ratchet is a ring gear having angularly spaced teeth 14 formed around its inner periphery. In this particular instance, the ring gear has an inside diameter of about 1.0" and is formed with thirty-six equally spaced teeth.

In accordance with the present invention, the teeth 14 of the ring gear 13 constantly mesh with the teeth 15 of an inner gear 16. When the handle 11 of the ratchet 10 is turned in a driving direction, the meshing teeth 14 and 15 transmit torque from the handle to the socket. When the handle is turned in the reverse direction, the ring gear 13 rolls around the inner gear 16 to permit the handle to free-wheel but the teeth 14 remain in meshing engagement with the teeth 15. As a result, the teeth are always positioned to immediately drive when the handle is again turned in the driving direction and thus there is no need to swing the handle further in the reverse direction to enable the drive to pick up. Accordingly, the ratchet can be used in extremely tight quarters since it requires no backswing in order to drive. At the same time, the interengaging gears 13 and 16 provide a rugged and positive drive from the handle 11 to the socket.

Herein, the inner gear 16 also is in the form of a ring but the teeth 15 are formed on the outer periphery of the ring. The specific gear 16 which has been shown in the drawings has an outside diameter of about 0.81" and is formed with thirty-six equally spaced teeth 15.

In carrying out the invention, the inner gear 16 is eccentrically supported on a center body 20 (FIG. 4) having a central axis which coincides with the axis 21 of the ring gear 13. More specifically, the lower end of the center body 20 includes a ⅜" square driver shank 23 adapted to telescope into the socket wrench. The driver projects downwardly from the ring gear 13 and its axis coincides with that of the ring gear.

Formed integrally with the upper end portion of the driver 23 and forming part of the center body 20 is a radially projecting flange 25 (FIG. 4) which is rotatably supported by a snap ring 26 located adjacent the lower end portion of the ring gear 13. There exists a small amount of radial clearance between the flange 25 and the ring gear 13 but the flange and the snap ring 26 coact to support the center body 20 to rotate about an axis coinciding substantially with the axis 21 of the ring gear.

The center body 20 further includes an eccentric 30 which is formed integrally with and extends upwardly from the flange 25. The eccentric is in the form of a solid cylindrical hub which is telescoped slidably and rotatably into the ring-like inner gear 16. As shown most clearly in FIG. 2, the axis 31 of the eccentric is offset radially from the axis 21 of the ring gear 13 by a distance e which herein is approximately 0.11".

Importantly, means lock the gears 13 and 16 against relative turning when the handle 11 of the ratchet 10 is turned in the driving direction, such locking causing torque to be transmitted from the handle to the center body 20 in order to turn the driver 23 and the socket. Such means release the gears for relative turning when the handle is turned in the opposite direction and thereby enable the handle to free wheel relative to the center body and the driver.

In the present instance, the aforementioned means comprise a curved member 35 (FIGS. 3, 4 and 6) which is generally in the shape of a crescent. The crescent 35 is located between the gears 13 and 16 with the convex side of the crescent facing the ring gear 13 and with the concave side of the crescent facing the inner gear 16 and curved generally on the same radius as the inner gear. As will become more apparent subsequently, the crescent 35 is free to float circumferentially of the gears 13 and 16 through a limited distance.

Figure 2:
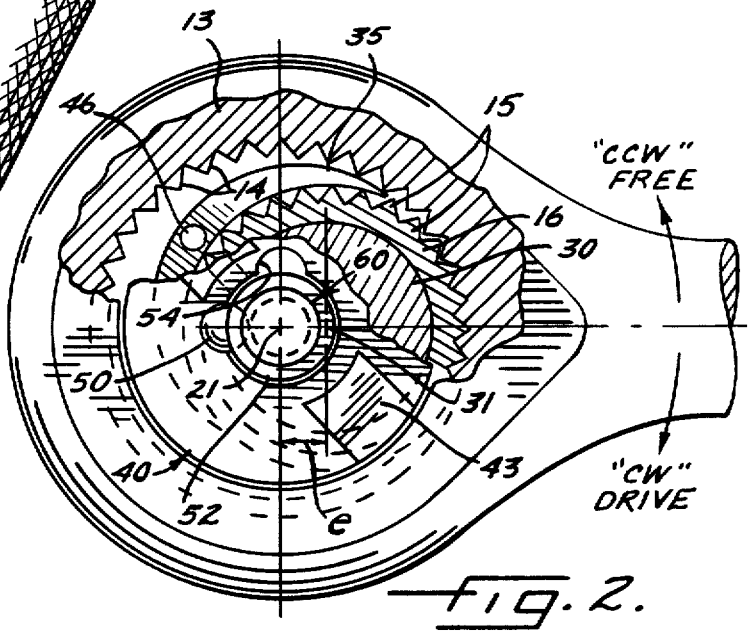
FIG. 2 is an enlarged fragmentary top plan view showing the ratchet set up to drive in a clockwise direction, certain parts of the ratchet being broken away and shown in section.

When the ratchet 10 is set to drive in a clockwise direction, the crescent 35 is positioned as shown in FIG. 2 and is located such that one of its end portions is located between the gears 13 and 16 in close proximity to the teeth 14 and 15 while the other end portion of the crescent is spaced a substantial distance from the teeth 14. When the ratchet handle 11 is turned clockwise, engagement of the teeth 14 with the convex side of the crescent tends to shift the crescent clockwise and thus wedges the leading end portion of the crescent between the teeth 14 and 15. As a result of such wedging, the gears 13 and 16 are locked against relative movement and, as the handle is turned clockwise, the locked gear 16 acts through the eccentric 30 to turn the driver 23 clockwise.

When the parts are positioned as shown in FIG. 2 and the handle 11 is turned counterclockwise, the teeth 14 of the ring gear 13 tend to shift the crescent 35 counterclockwise and thus the crescent moves out of wedging engagement with the teeth 14 and 15. As a result, counterclockwise turning of the handle results in the teeth 14 engaging the teeth 15 and turning the gear 16 counterclockwise on the eccentric 30. During such turning, the teeth 14 roll into and out of the teeth 15 and thus the handle 11 and the ring gear 13 free-wheel relative to the center body 20 and the driver 23. This enables the handle to be returned freely to a position to make another clockwise driving stroke. As the handle returns, the teeth 14 remain in constant engagement with the teeth 15 as the teeth 14 roll into and out of the teeth 15. As a result, the next driving stroke may begin precisely at the point where the return stroke stopped and there is no need to take an additional backstroke with the handle to pick up the drive. This enables the ratchet 10 to be used in very tight spaces where there is only limited room to swing the handle.

Figure 3:
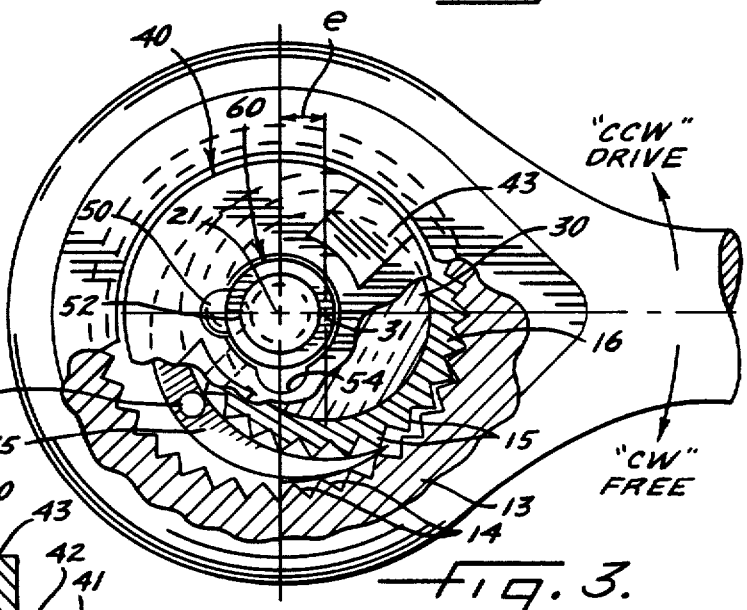
FIG. 3 is a view similar to FIG. 2 but shows the ratchet set up to drive in a counterclockwise direction.

FIG. 3 shows the crescent 35 positioned to cause the ratchet 10 to drive in a counterclockwise direction and to free-wheel in a clockwise direction. When the crescent is so positioned, the opposite end portion of the crescent is wedged between the teeth 14 and 15 when the handle 11 is turned counterclockwise and is released from wedging engagement when the handle is turned clockwise. Otherwise, the operation of the ratchet is the same as described above with reference to FIG. 2.

Provision is made of a reversing element or cap 40 (FIGS. 1, 4 and 6) for selectively shifting the crescent 35 between the positions shown in FIGS. 2 and 3. In this instance, the reversing cap 40 includes a rotatable disc 41 which underlies a flange 42 adjacent the upper end of the ring gear 13. Two diametrically spaced lugs 43 project upwardly from the disc and define finger grips for facilitating manual turning of the reversing cap 40.

As shown most clearly in FIG. 6, an elongated slot 45 is formed in the underside of the disc 41 of the cap 40 and is adapted to pivotally receive a short cylindrical pin 46 which projects upwardly from the upper side of the crescent 35 at the midpoint thereof. The pin 46 fits in the slot 45 with sliding radial clearance and with a limited degree of circumferential clearance. When the reversing cap is located as shown in FIG. 2, the slot 45 and the pin 46 coact to position the crescent 35 so as to effect clockwise driving. When the handle 11 is first turned in a clockwise direction, the radial and circumferential clearance between the pin and the slot permit the crescent to float relative to the disc 41 to the extent necessary for the crescent to move into wedging engagement with the gear teeth 14 and 15.

When the reversing cap 40 is turned through 90 degrees in a counterclockwise direction from the position shown in FIG. 2 to that shown in FIG. 3, the trailing side of the slot 45 engages the pin 46 to shift the crescent 35 to its counterclockwise driving position shown in FIG. 3. Again, the clearance between the pin and the slot permits the crescent to float through a limited distance as the crescent is shifted between its positions.

Detent means are provided for holding the reversing cap 40 releasably in either of its two positions. In this instance, the detent means comprise a spherical ball 50 which is located in an opening or window 51 (FIG. 4) formed in one side of a sleeve 52, the latter constituting part of the center body 20 and projecting upwardly from the eccentric 30. The sleeve extends upwardly through an opening 53 (FIG. 6) in the reversing cap 40 and its axis coincides with the axis 21 of the ring gear 13.

The detent ball 50 normally extends outwardly through the window 51 in the sleeve 52 and normally seats in one of a pair of notches 54 (FIG. 6) formed in the disc 41 of the cap 40 and located adjacent the opening 53 in the disc. The notches are spaced 90 degrees from one another and are located on opposite sides of the slot 45. When the ball 50 is seated in one of the notches 53, it holds the reversing cap 40 in the position shown in FIG. 2. The reversing cap is held in the position shown in FIG. 3 when the ball is seated in the other notch.

Figure 4:
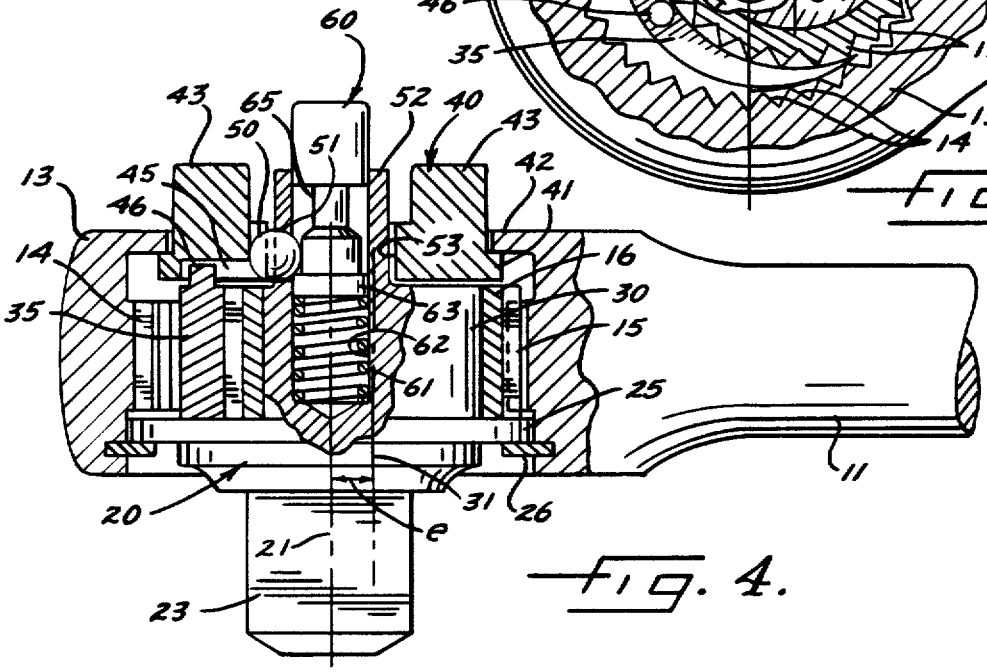
FIG. 4 is an enlarged fragmentary cross-section taken substantially along the line 4—4 of FIG. 1.

A plunger 60 normally holds the ball 50 in the notches 54 and may be depressed manually to release the ball from the notches. The plunger 60 is telescoped into the sleeve 52 and is urged upwardly by a coiled compression spring 61 (FIG. 4) located in a bore 62 in the eccentric 30. Normally, a flange 63 on the lower end of the plunger engages the lower side of the ball 50 as shown in FIG. 4 and cams the ball outwardly within the window 51 to a position where the ball is captivated between the window and one of the notches 54 in the reversing cap 40. As a result, the ball prevents the reversing cap from rotating relative to the center body 20 and thus causes the cap to hold the crescent 35 in one of its two positions relative to the center body.

The plunger 60 is formed with a circumferentially extending groove 65 (FIG. 5) which moves downwardly into alinement with the ball 50 when the plunger is depressed downwardly to the position shown in FIG. 5. This frees the ball to move inwardly within the window 51 and to leave the notch 54 in the reversing cap 40. As a result, the reversing cap may be turned to its other position to effect reversal of the drive direction of the ratchet 10.

From the foregoing, it will be apparent that the present invention brings to the art a new and improved ratchet 10 in which the drive is effected by way of the two gears 13 and 16 having relatively coarse teeth 14 and 15. Thus, the drive is positive and, in addition, the ratchet is rugged and durable since there is little danger of the teeth shearing. At the same time, the drive picks up instantly regardless of the position of the handle 11 since the teeth 14 and 15 remain in constant engagement. Accordingly, there is no need for extra backswing and thus the ratchet may be used in tight spaces.

It should also be noted that there is very little drag between the gears 13 and 16 when the handle 11 is swung in the non-driving direction since the teeth 14 roll smoothly into and out of the teeth 15. Because of the low drag, the ratchet does not cause a relatively loose fastener to turn during the backstroke of the ratchet.

I claim:

1. A ratchet comprising an elongated handle, a ring gear rigid with one end of said handle and having teeth spaced angularly around its inner periphery, said gear being circular and having a central axis, a center body supported for rotation about said axis and within said gear and having a driver which is concentric with said central axis, said center body having an eccentric with an axis which is offset radially with respect to said central axis, an inner gear having angularly spaced teeth and supported on said eccentric to rotate relative to the eccentric about the axis thereof, some of the teeth of said inner gear meshing with some of the teeth of said ring gear, means for locking said gears against relative rotation when said handle is turned in one direction whereby rotation of said handle in said one direction is transmitted to said center body and said driver by way of said gears, said locking means comprising a member adapted to wedge between the teeth of said ring gear and the teeth of said inner gear to lock the gears against relative rotation when said handle is turned in said one direction, said member releasing said gears for turning relative to one another when said handle is turned in the opposite direction whereby said handle may rotate without rotating said center body and said driver.

2. A reversible ratchet comprising an elongated handle, a ring gear rigid with one end of said handle and having teeth spaced angularly around its inner periphery, said gear being circular and having a central axis, a center body supported for rotation about said axis and within said gear and having a driver which is concentric with said central axis, said center body having an eccentric with an axis which is offset radially with respect to said central axis, an inner gear having angularly spaced teeth and supported on said eccentric to rotate relative to the eccentric about the axis thereof, some of the teeth of said inner gear meshing with some of the teeth of said ring gear, means for locking said gears against relative rotation when said handle is turned in one direction whereby rotation of said handle in said one direction is transmitted to said center body and said driver by way of said gears, said locking means releasing said gears for turning relative to one another when said handle is turned in the opposite direction whereby said handle may rotate without rotating said center body and said driver, and means for shifting said locking means relative to said gears between (A) a first position in which said locking means lock said gears when said handle is turned clockwise and release said gears when said handle is turned counterclockwise and (B) a second position in which said locking means lock said gears when said handle is turned counterclockwise and release said gears when said handle is turned clockwise.

3. A reversible ratchet as defined in claim 2 in which said locking means comprise a curved member extending circumferentially between said ring gear and said inner gear and movable between said positions, said member having one end portion adapted to wedge between said gears when said member is in said first position and said handle is turned clockwise, said member having an opposite end portion adapted to wedge between said gears when said member is in said second position and said handle is turned counterclockwise.

4. A reversible ratchet as defined in claim 3 in which said curved member is in the general shape of a crescent.

5. A reversible ratchet as defined in claim 3 further including means supporting said curved member to float generally radially of said central axis.

6. A reversible ratchet as defined in claim 3 in which said shifting means comprise a reversing element supported to rotate about said central axis and operable when turned to shift said curved member generally circumferentially of said gears and between said first and second positions.

7. A reversible ratchet as defined in claim 6 further including a connection between said curved member and said reversing element, said connection causing said curved member to shift circumferentially when said reversing element is rotated while permitting said curved member to float relative to said reversing element and generally radially of said central axis.

8. A reversible ratchet as defined in claim 7 in which said connection comprises a slot formed in said reversing element and further comprises a pin joined to said curved member and projecting into said slot, said slot extending generally radially of said central axis.

9. A reversible ratchet as defined in claim 8 in which said pin and said slot support said curved member to pivot about the axis of said pin.

10. A reversible ratchet as defined in claim 6 further including means for releasably holding said reversing element in first and second angularly spaced positions relative to said center body.

11. A reversible ratchet as defined in claim 10 in which said holding means comprise a spring-loaded detent operably connected between said reversing element and said center body.

12. A reversible ratchet as defined in claim 11 further including manually operable means for selectively moving said detent to a position disconnecting said reversing element from said center body.

13. A reversible ratchet comprising an elongated handle, a ring gear rigid with one end of said handle and having teeth spaced angularly around its inner periphery, said gear being circular and having a central axis, a center body supported for rotation about said axis and within said gear and having a driving shank which is concentric with said central axis, said center body having an eccentric hub with an axis which is offset radially with respect to said central axis, an annular inner gear supported on said eccentric hub to rotate relative to the eccentric hub about the axis thereof, said inner gear having teeth spaced angularly around its outer periphery, some of the teeth of said inner gear meshing with some of the teeth of said ring gear, a curved member operable to wedge between said gears to lock said gears against relative rotation when said handle is turned in one direction whereby rotation of said handle in said one direction is transmitted to said center body and said driving shank by way of said gears, said locking means moving out of wedging engagement with said gears and releasing said gears for turning relative to one another when said handle is turned in the opposite direction whereby said handle may rotate without rotating said center body and said driver, and a manually movable reversing element for shifting said curved member relative to said gears between (A) a first position in which said curved member locks said gears when said handle is turned clockwise and releases said gears when said handle is turned counterclockwise and (B) a second position in which said curved member locks said gears when said handle is turned counterclockwise and release said gears when said handle is turned clockwise.

* * * * *